US005300937A

United States Patent [19]

Capp et al.

[11] Patent Number: 5,300,937

[45] Date of Patent: Apr. 5, 1994

[54] LOOP ANTENNA

[75] Inventors: John K. Capp, Boca Raton; Keith W. Neutzman, West Palm Beach; John J. Parkes, Jr., Lantana, all of Fla.

[73] Assignee: Motorola, Inc, Schaumburg, Ill.

[21] Appl. No.: 948,078

[22] Filed: Sep. 21, 1992

Related U.S. Application Data

[63] Continuation of Ser. No. 686,851, Apr. 18, 1991, abandoned, which is a continuation of Ser. No. 416,090, Oct. 2, 1989, abandoned.

[51] Int. Cl.[5] ..... H01Q 1/22; H01Q 7/00

[52] U.S. Cl. ..... 343/702; 343/741; 343/742

[58] Field of Search ..... 343/702, 741, 742, 744; H01Q 1/24, 1/22, 7/00, 7/02

[56] References Cited

U.S. PATENT DOCUMENTS

| | | | |
|---|---|---|---|
| 3,736,591 | 5/1973 | Rennels et al. | 343/702 |
| 3,946,397 | 3/1976 | Irwin | 343/788 |
| 3,969,728 | 7/1976 | Hodsdon et al. | 343/702 |
| 4,123,756 | 10/1978 | Nagata et al. | 343/702 |
| 4,471,493 | 9/1984 | Schober | 343/702 |
| 4,625,212 | 11/1986 | Oda et al. | 343/702 |
| 4,920,352 | 4/1990 | Martensson et al. | 343/702 |

FOREIGN PATENT DOCUMENTS

| | | | |
|---|---|---|---|
| 331486 | 9/1989 | European Pat. Off. | H01Q 1/24 |
| 60-7204 | 1/1985 | Japan | 343/702 |

*Primary Examiner*—Michael C. Wimer

*Attorney, Agent, or Firm*—Gregg E. Rasor; Thomas G. Berry; Daniel R. Collopy

[57] ABSTRACT

An antenna system maximizes a gain associated an antenna loop by expanding a free end away from a fixed end of the loop in response to first and second portions of the antenna loop resiliently engaging first and second interior sides of a housing to maintain the position of the antenna loop and increase the effective area of the antenna loop.

5 Claims, 1 Drawing Sheet

LOOP ANTENNA

This is a continuation of application Ser. No. 07/686,851, filed Apr. 18, 1991 and now abandoned, which is a continuation of application Ser. No. 07/416,090, filed Oct. 2, 1989 and now abandoned.

FIELD OF THE INVENTION

This invention relates in general to antennas and more particularly to a radio frequency loop antenna.

BACKGROUND OF THE INVENTION

Antennas for the transmission and reception of radio frequency information are well known to those skilled in the art. Loop antennas, such as those used in portable radio receivers, are typically formed of a round wire or flat strip of conductive material.

The placement and retention of the loop antenna structure within a portable receiver's housing is critical. Even slight variations in antenna positioning within the housing can cause severe antenna performance degradation. All known methods to prevent an antenna structure from uncontrollably changing position within a housing have concentrated on using rigid (no spring characteristics) antenna members, physical restraints, or both. These methods add unnecessary weight to a product and complicate the assembly process.

Thus, what is needed is a loop antenna that automatically conforms to its surrounding mechanical environment to ease assembly and optimize antenna performance.

SUMMARY OF THE INVENTION

Briefly, according to the invention, there is provided an antenna system comprising a housing and an antenna loop having a gain and being integrally formed of a first and a second portion, the antenna loop having a fixed end that is coupled to a circuit board and a free end opposite thereto, the first and second portions of the antenna loop each including respective first and second bends forming obtuse angles of less than 180 degrees as measured between respective first and second ends of each portion, the first and second portions being compressed when the antenna loop is inserted in the housing resulting in first and second forces exerted in opposite directions by said first and second bends against respective first and second interior sides of the housing, the first and second forces acting to maximize the gain and a corresponding effective area encompassed by the antenna loop by expanding the free end away from the fixed end when the first and second portions resiliently engage the first and second interior sides of the housing to maintain the position of the antenna loop within the housing.

DETAILED DESCRIPTION OF THE INVENTION

Figure 1:
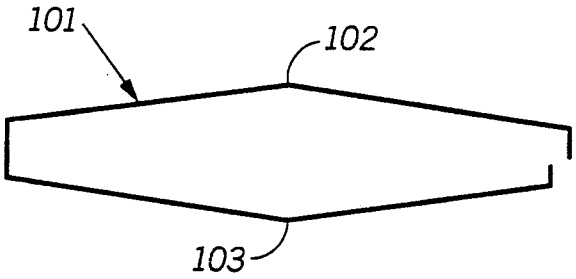
FIG. 1 is the "relaxed" profile of the single loop antenna member in accordance with the preferred embodiment.

Referring to FIG. 1, a single loop antenna member 101 is "relaxed" (no vertical compression applied), whereby the bent members 102, 103, are bowed outward from the interior portion of the loop. Since the loop is formed of a spring tempered conductive material, the loop will maintain this form when no external forces are applied.

Figure 2:
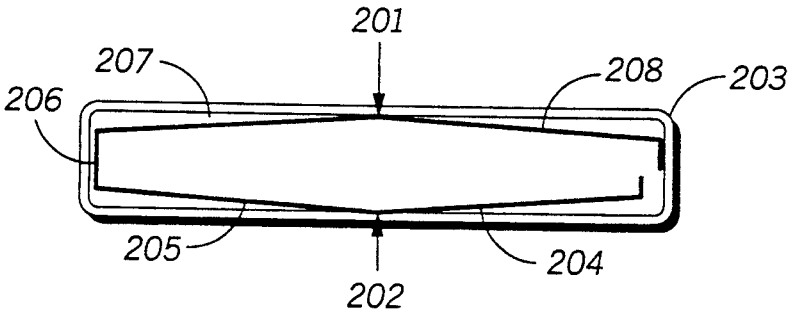
FIG. 2 is the "stressed" profile of a single loop antenna member in accordance with the preferred embodiment.

Referring to FIG. 2, the "stressed" (compression applied at points 201 and 202) profile of a single loop antenna member is shown. When the loop antenna from FIG. 1 is inserted into the radio housing 203, the overall structure formed by the conductor 204, 205, 206, 207, 208, will shorten vertically and lengthen horizontally to conform within the radio housing 203. Note that the length of the sections comprising the single loop antenna member 204, 205, 206, 207, 208, remain constant while stressed, thus, as the overall vertical height of the loop structure decreases, the effective loop area increases. In order to achieve optimal conformance to the housing 203 and maximize the effective loop area (thus increasing the antenna gain), the end member 206 is free to move.

By using the spring properties of the conductor material, the loop antenna member 204, 205, 206, 207, 208, is held against the radio housing 203 and away from any components inside the radio. This improves the electrical properties of the loop antenna by decreasing the electromagnetic loading (interference with the desired electromagnetic field pattern by surrounding dielectrics and/or conductors) and allows for operating the loop antenna at maximum efficiency.

Figure 3:
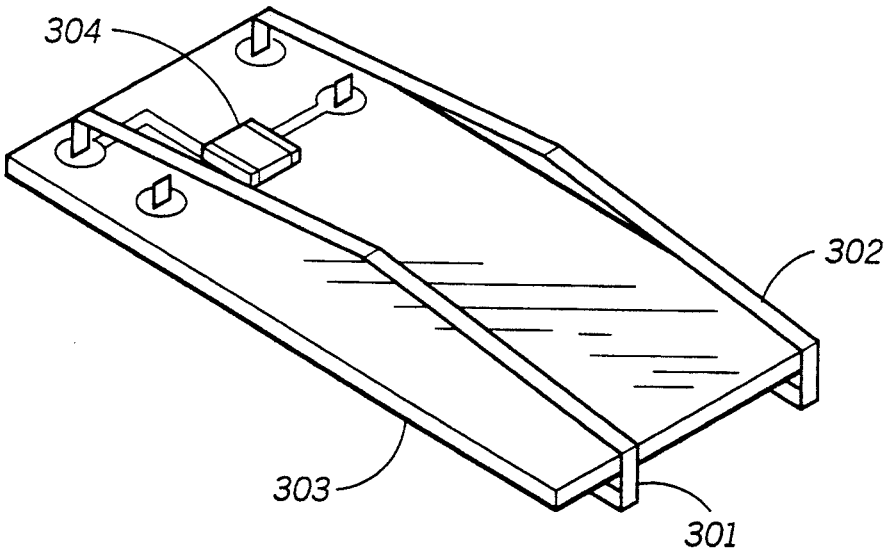
FIG. 3 is an isometric view of a two loop antenna system.

Referring to FIG. 3, a dual loop antenna system comprises a first member 301 and second member 302 that are reactively coupled and mounted on the printed circuit board 303. The dual loop antenna system is tuned by resonating each member with an impedance 304 coupled thereto. This impedance 304 may be shared between a plurality of members in a system comprised of two or more members. The antennas are mounted in the same horizontal plane and oriented in the same "sense" to provide mutual coupling. This "sense" as it is referred to in electronics, is the turn direction of a winding (or loop in this case) belonging to an inductor, such that the current induced in a first winding provides mutually constructive electromagnetic coupling with any or all windings constructed in the same plane and axis as the first winding. When the antenna system is inserted into an appropriate radio housing, the antenna members 301, 302, will automatically conform to the internal height dimensions of the housing. The spring tension exerted by the antenna members when conformed is sufficient to prevent dislocation or misalignment of the members when subjected to mechanical shock or vibration.

We claim:

1. A loop antenna adapted for insertion within a housing, comprising:

a first portion having first and second ends, the first portion including a first bend forming an obtuse angle of less than 180 degrees as measured between the first and second ends of the first portion; and a second portion having first and second ends, the second portion including a second bend forming an obtuse angle of less than 180 degrees as measured between the first and second ends of the second portion, the second portion being integrally formed with the first portion, the first and second portions of the loop antenna being compressed when inserted in the housing due to first and second forces exerted in substantially opposite directions against respective first and second interior sides of the housing by the first and second bends, the first and second forces acting to resiliently engage the first and second portions of the loop antenna with the respective first and second interior sides of the housing for maintaining the loop antenna in a position within the housing that maximizes an effective capture area encompassed by the loop antenna.

2. The loop antenna system according to claim 1 wherein said first and second portions have at least one impedance coupled thereto.

3. The antenna system according to claim 1 wherein said first and second portions are oriented to provide mutual electromagnetic coupling therebetween.

4. An antenna system, comprising:

a housing; and an antenna loop having a gain and being integrally formed of a first and a second portion, the antenna loop having a fixed end that is coupled to a circuit board and a free end opposite thereto, the first and second portions of the antenna loop each including respective first and second bends forming obtuse angles of less than 180 degrees as measured between respective first and second ends of each portion, the first and second portions being compressed when the antenna loop is inserted in the housing resulting in first and second forces exerted in opposite directions by said first and second bends against respective first and second interior sides of the housing, the first and second forces acting to maximize the gain and a corresponding effective area encompassed by the antenna loop by expanding the free end away from the fixed end when the first and second portions resiliently engage the first and second interior sides of the housing to maintain the position of the antenna loop within the housing.

5. An antenna system having a gain, comprising:

a housing;

a first antenna loop integrally formed of first and second portions, the antenna loop having a fixed end that is coupled to a circuit board and a free end opposite thereto such that a first effective area encompassed by the first antenna loop is maximized by expanding the free end away from the fixed end in response to first and second forces exerted in substantially opposite directions against respective first and second interior sides of the housing by a first and a second bend included in respective first and second portions, the first and second bends forming obtuse angles of less than 180 degrees as measured between respective first and second ends of each portion;

a second antenna loop integrally formed of first and second portions and reactively coupled to the first antenna loop, the second antenna loop having a fixed end that is coupled to a circuit board and a free end opposite thereto such that a second effective area encompassed by the second antenna loop is maximized by expanding the free end away from the fixed end, the second antenna loop comprising first and second portions having respective first and second bends forming obtuse angles of less than 180 degrees as measured between respective first and second ends of each portion, the first and second portions of the first and second antenna loops being compressed due to first and second forces exerted in substantially opposite directions against respective first and second interior sides of the housing by respective first and second bends of the first and second portions comprising the first and second antenna loops when the first and second antenna loops are inserted in the housing, and upon insertion, the bends included in respective first and second portions of the first and second antenna loops resiliently engage the first and second interior sides of the housing to maintain the position of the first and second antenna loops within the housing, and in response to each of the loops being compressed, each of the bends in the first and second portions of the first and second antenna loops exerting a force in opposing directions against the first and second interior sides of the housing, the opposing forces acting to expand each of the free ends of the first and second antenna loops away from their corresponding fixed ends to maximize the gain of the antenna system by increasing a total effective area corresponding to a sum of the first and second effective areas of the first and second antenna loops.

* * * * *